US007827887B2

(12) United States Patent
Lee

(10) Patent No.: US 7,827,887 B2
(45) Date of Patent: Nov. 9, 2010

(54) RATCHET WRENCH

(75) Inventor: Li-Ju Lee, Taichung (TW)

(73) Assignee: Kung-Cheng Chen, Taichung (TW)

( * ) Notice: Subject to any disclaimer, the term of this patent is extended or adjusted under 35 U.S.C. 154(b) by 251 days.

(21) Appl. No.: 12/245,075

(22) Filed: Oct. 3, 2008

(65) Prior Publication Data

US 2010/0083797 A1 Apr. 8, 2010

(51) Int. Cl.
*B25B 13/12* (2006.01)
*B25B 13/46* (2006.01)

(52) U.S. Cl. ..... 81/179; 81/186

(58) Field of Classification Search ..... 81/179, 81/92, 94, 186

See application file for complete search history.

(56) References Cited

U.S. PATENT DOCUMENTS 1,320,668 A * 11/1919 Askman ..... 81/179
2,797,600 A * 7/1957 Beaver ..... 81/179
3,695,125 A * 10/1972 Glass et al. ..... 81/179
3,921,474 A * 11/1975 Dyck et al. ..... 81/91.2
4,158,975 A * 6/1979 DeSousa ..... 81/179
5,287,777 A * 2/1994 Kolodziej ..... 81/179
7,024,971 B2 * 4/2006 Stanton ..... 81/179

* cited by examiner

*Primary Examiner*—David B Thomas
(74) *Attorney, Agent, or Firm*—Eschweiler & Associates, LLC

(57) ABSTRACT

A ratchet wrench allowing ratcheting rotations for applying a series of turning strokes to a bolt without disengaging between the strokes. The ratchet wrench has a wrench body and a ratcheting jaw. The wrench body has a head and a curved slot. The head has an inner surface. The curved slot is formed in the inner surface of the head. The ratcheting jaw is slidably mounted in the curved slot for applying a torque to a blot head during a rotation in the forward direction as well as for ratcheting rotation during a backward rotation.

11 Claims, 12 Drawing Sheets

RATCHET WRENCH

BACKGROUND OF THE INVENTION

1. Field of the Invention

The present invention relates to a wrench, especially to a ratchet wrench that is applied in unidirectional.

2. Description of the Prior Art

With reference to FIG. 12, a conventional ratchet wrench disclosed in U.S. Pat. No. 7,111,529 comprises a head (40), a tapered coil spring (44), a retractable jaw member (45) and two cover plates (46). The head (40) has a front end. An opening (41) is defined in the front end of the head (40) and has a peripheral surface, a first side and a second side. Multiple recessions are formed on the peripheral surface of the opening (41) at intervals. The recessions are used for providing ratcheting space when rotates a bolt in a backward direction. Respectively corresponding to the first side and the second side of the opening (41), a first jaw (42) and a second jaw (43) are formed on the head (40). The second jaw (43) has an inner surface. A slot (431) is defined in the inner surface of the second jaw (43) and has an inner end. Two recesses are defined in two sides of the second jaw (43) and communicate with the slot (431). The tapered coil spring (44) is mounted in the slot (431) and has an outer end. The retractable jaw member (45) is mounted in the slot (431) and has a side surface. The retractable jaw member (45) abuts against the outer end of the tapered coil spring (44) and projects into the opening (41). The two cover plates (46) are respectively attached to and close the recesses in the second jaw (43).

When using the conventional ratchet wrench, the peripheral surface of the opening (41) and the side surface of the retractable jaw member (45) engage a head of a bolt. The head of the bolt has multiple flats and multiple corners formed between adjacent flats. In order to tighten the blot, a torque is applied to the blot head with a turning stroke in a forward direction. Rotating the conventional ratchet wrench in the backward direction is necessary for tightening the blot. When the head (40) is rotated in the backward direction about the head of the bolt, the retractable jaw member (45) will be, pressed into the slot (43) by the flats of the bolt head to disengage the jaw member (45) from the blot head. Thus, the head (40) would be ratchetingly rotated in the backward direction to a position suitable for next turning stroke in the forward direction. Repeating backward and forward rotations allows tightening the bolt without removing the conventional ratcheting wrench from the bolt.

Although the conventional ratchet wrench can tighten bolts with a series of sequential backward and forward rotations, the conventional ratchet wrench still has following problems.

1. In order to mount a resilient member in the narrow slot (431), a tapered coil spring (44) is used as for abutting the retractable jaw member (45). It is also appreciated by an artisan with general knowledge in the field that the tapered coil spring (44) may also be replaced with a resilient member having features and functions similar to that of the tapered coil spring (44). In addition, the tapered coil spring (44) is characterized by occupying less space when compressed. Using the tapered coil spring (44) allows the slot (431) to be made shallower and smaller than using a normal coil spring to miniaturize the conventional ratchet wrench. The tapered coil spring (44), however, takes a cost much more than a normal coil spring does. It is observed in the field that there is a need for a ratchet wrench suitable for miniaturizing and employing a low-cost coil spring.

2. In order to mount the tapered coil spring (44) into the slot (431), the inner end of the slot (431) has to be formed at a right angle. Precise casting process, linear cutting process or LASER cutting process would be necessary for making such structure, and this significantly raises manufacturing cost for the convention ratchet wrench. The cutting process for forming the slot (431) may be preceded after a different cutting process for forming the opening (41) with a central machine tool. Consequently, precision for forming the ratchet wrench is reduced due to the aforementioned two individual cutting processes.

3. In order to provide sufficient retracting space for the retractable jaw member (45), the slot (431) must have an enough depth. The second jaw (43) needs to have a thick thickness for defining a deep slot (431). Otherwise, the structural strength may not be strong enough to prevent failure.

4. With the aforementioned thick thickness of the second jaw (43), miniaturizing the conventional ratchet wrench would be impossible. As a result, the application of the conventional ratchet wrench is extremely limited, especially is not applied for small bolts.

5. The retractable jaw member (45) of the conventional ratchet wrench retracts in a linear movement travel, so the side surface of the retractable jaw member (45) projects out from the recession (431) and provides only a small area for contacting the bolt head. Such structure causes unexpected and unsafe slipping during use. Since no extra space is available for the side surface due to the linear movement of the retractable jaw member (45), the conventional bolt is not applicable for bolts slightly different in sizes.

6. Two projections (432) may be formed on the bottom of each recess for connecting with a corresponding cover plate (46). When attaching the cover plates (46) to the recesses, the projections (432) are melted and welded with the cover plates (46). However, visible welding marks appear on and around the cover plate (46) with such a welding process. Furthermore, the structural strength of combination of the cover plates (46) with the recesses is not enough for bearing a shock to cause cover plates (46) escaping from the recesses.

To overcome the shortcomings, the present invention provides a ratchet wrench to mitigate or obviate the aforementioned problems.

SUMMARY OF THE INVENTION

The main objective of the invention is to provide a ratchet wrench overcoming the problems or shortcomings of the conventional ratchet wrench.

The ratchet wrench in accordance with the present invention has a wrench body and a ratcheting jaw. The wrench body has a head and a curved slot. The head has an inner surface. The curved slot is formed in the inner surface of the head. The ratcheting jaw is slidably mounted in the curved slot for applying a torque to a blot head during a rotation in the forward direction as well as for ratcheting rotation during a backward rotation.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
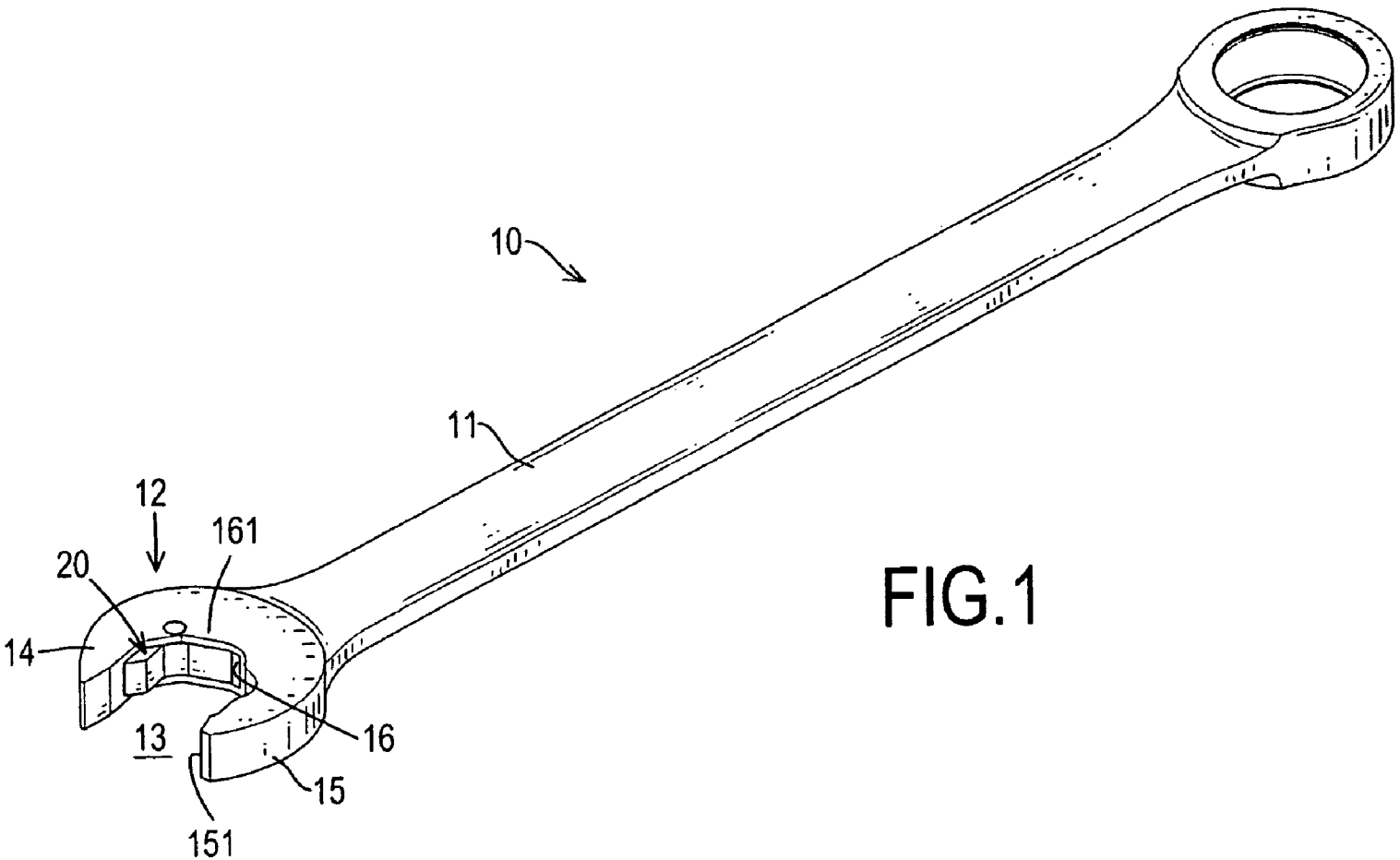
FIG. 1 is a perspective view of a first embodiment of a ratchet wrench in accordance with the present invention.
Figure 2:
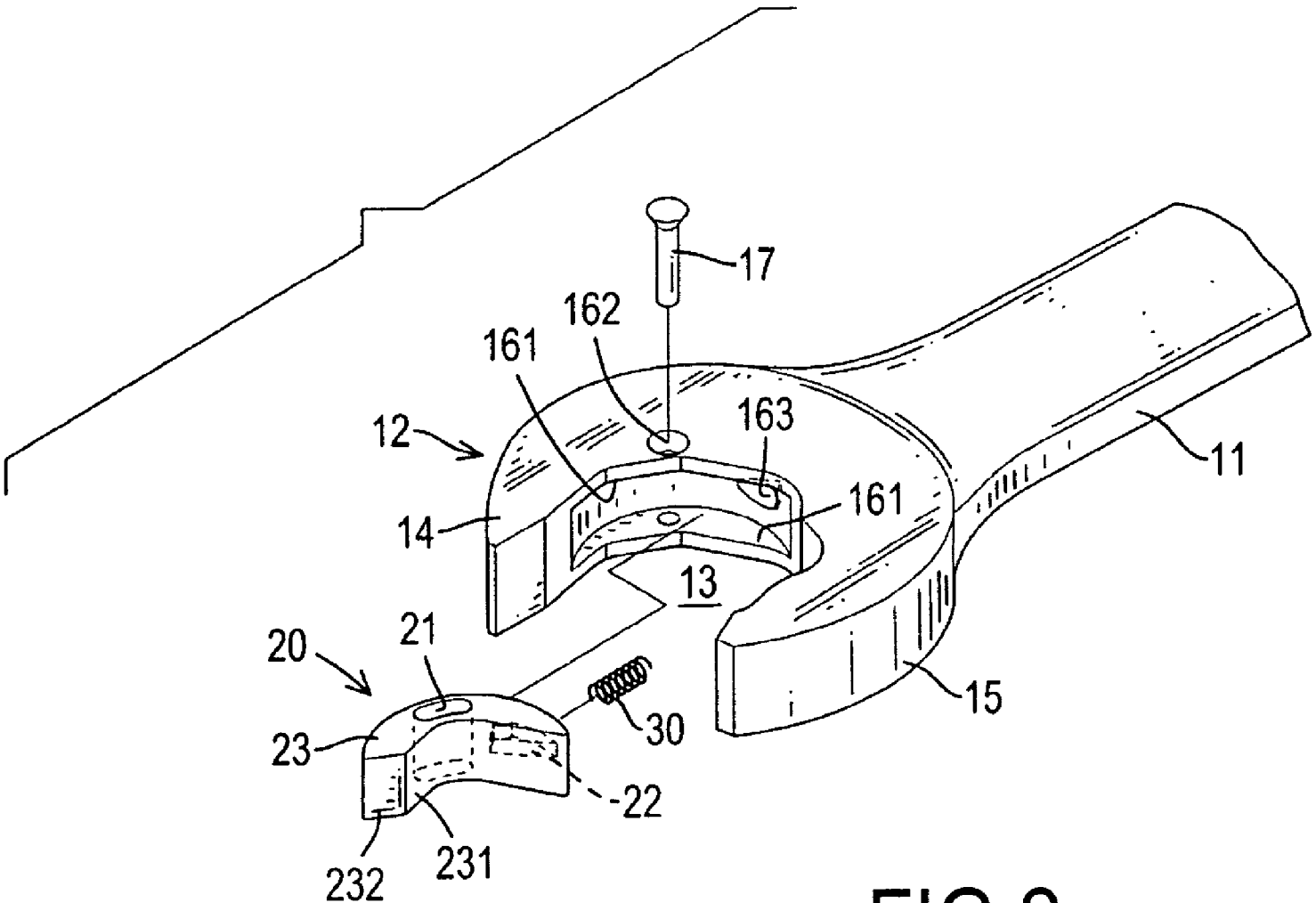
FIG. 2 is an exploded perspective view of the ratchet wrench in FIG. 1.

With reference to FIGS. 1 to 4B, a first embodiment of a ratchet wrench in accordance with the present invention comprises a wrench body (10), a ratcheting jaw (20) and a spring (30). The wrench body (10) comprises a handle (11), a head (12), an opening (13), a first jaw (14), a second jaw (15) and a curved slot (16).

The handle (11) comprises a front end. The head (12) is formed on the front end of the handle (11) and comprises a front end, a rear end, a first side, a second side and an inner surface. In the first embodiment, the head (12) is disk-shaped. The opening (13) is defined in the front end of the head (12) and comprises a forward area, a backward area, a central area, a first side, a second side and a peripheral surface. The peripheral surface is the inner surface of the head (12). For ease of description in configuration and actions relates to the opening (13), the inner surface of the head (12) is assigned as the peripheral surface of the opening (13).

In the present invention, a backward area is defined within a structural member or feature, as an area heading toward the backward direction during a ratcheting rotation of the head (12) in the backward direction. Opposite to the backward area, a forward area is defined within the structural member or feature, as an area heading toward the forward direction while the head (12) being rotated in the forward direction.

The first jaw (14) is formed on the head (12) at a position corresponding to the first side of the opening (13) and comprises an inner surface. The inner surface of the first jaw (14) has a central area, a front end and a rear end. The second jaw (15) is formed on the head (12) at a position corresponding to the second side of the opening (13) and comprises an inner surface. The inner surface of the second jaw (15) has a front end and a rear end.

The second jaw (15) may further have a limiting protrusion (151), an engaging surface (152) and a supporting surface (153). The limiting protrusion (151) is formed on the front end of the inner surface of the second jaw (15) and comprises a rear side. The engaging surface (152) is formed on the inner surface of the second jaw (15) adjacent to the rear side of the limiting protrusion (151) and has a rear side. The supporting surface (153) is formed on the rear end of the inner surface of the second jaw (15) and corresponds to the rear side of the engaging surface (152) and inclined at an angle of 60 degrees relative to the engaging surface (152).

Since the aforementioned first jaw (14) is heading toward the backward direction, a backward area within a structural member or feature is usually closer to the first jaw (14) and more distant to the second jaw (15) than a backward area be. Thus, the backward area of the opening (13) is defined within the opening (13) as an area adjacent to the first jaw (14). The forward area of the opening (13) is defined within the opening (13) as an area adjacent to the second jaw (15).

The curved slot (16) is formed in the inner surface of the head (12), corresponds to the peripheral surface of the opening (13) and comprises a central area, a forward area, a backward area, an inner surface, at least one side and at least one side wall (161). The backward area of the curved slot (16) is defined within the curved slot (16), as an area heading toward the backward direction during a ratcheting rotation of the head (12) in the backward direction. Opposite to the backward area, the forward area of the curved slot (16) is defined within the curved slot (16) as an area heading toward the forward direction while the head (12) being rotated in the forward direction. The inner surface of the slot (16) may be formed as an arc being a segment of a single circle or as a series of arcs each being a segment of a different circle. The least one side wall (161) is formed on the at least one side of the slot (16).

In the first embodiment, the curved slot (16) has two side walls (161) and two pinholes (162). The side walls (161) are formed respectively on two sides of the curved slot (16). The two pinholes (162) are formed respectively through the two side walls (161). The first jaw (14) further has a pin (17) inserted through the pinholes (162) and the slot (16). The pin (17) may be a rivet or a screw. The groove (16) further has a bottom recess (163). The bottom recess (163) is formed in the inner surface near the backward area of the slot (16) and has a forward area.

The ratcheting jaw (20) is a curved block capable of sliding forward and retracting backward inside the slot (16) and comprises a forward area, a backward area, an inner surface, an outer surface and an engaging area (23). The backward area of the ratcheting jaw (20) is defined within the ratcheting jaw (20), as an area heading toward the backward direction during a ratcheting rotation of the head (12) in the backward direction. Opposite to the backward area, the forward area of the ratcheting jaw (20) is defined within the ratcheting jaw (20) as an area heading toward the forward direction while the head (12) being rotated in the forward direction. The outer surface of the ratcheting jaw (20) has a shape that corresponds to the inner surface of the curved slot (16) to allow the ratcheting jaw (20) to slide inside the curved slot (16). The ratcheting jaw (20) further has a guide hole (21). The guide hole (21) is a curved hole and has a forward area and a backward area. The backward area of the guide hole (21) is defined within the guide hole (21), as an area heading toward the backward direction during a ratcheting rotation of the head (12) in the backward direction. Opposite to the backward area, the forward area of the guide hole (21) is defined within the guide hole (21) as an area heading toward the forward direction while the head (12) being rotated in the forward direction. The pin (17) penetrates the guide hole (21). More precisely, the pin (17) penetrates through the slot (16) and the forward area of the guide hole (21). A ratcheting space (A) is form between the forward area of the guide hole (21) and the pin (17) to allow the ratcheting jaw (20) to slightly slide in a backward direction.

The inner surface in the backward area of the ratcheting jaw (20) has a shape corresponding to the peripheral surface of the opening (13) to tightly engage a head of a bolt (C). The ratcheting jaw (20) further has a spring recess (22). The spring recess (22) is formed in the outer surface at the forward area of the ratcheting jaw (20), corresponds to the bottom recess (163) and has a backward area. According to the aforementioned definition of a forward area, the forward area of the ratcheting jaw (20) is an area within the ratcheting jaw (20) that is heading toward the forward direction during forward rotation. Thus the spring recess (22) could be described to have an opening and a bottom. The bottom would be heading the backward direction. In the opposite, the opening heads to the forward direction. As the aforementioned definition of a backward area recites, the backward area of the spring recess (22) is defined as an area including the bottom.

The head of the bolt (C) has multiple flats and multiple corners formed between adjacent flats. When engaging the head of the bolt (C), an escaping space (B) is formed between the inner surface of the ratcheting jaw (20) and a corner at a rear end of the head of the bolt (C). Because of the escaping space (B), when the head (12) is rotated in the forward or backward direction, the corner of the bolt head of the bolt (C) and the inner surface of the ratcheting jaw (20) do not contact with each other. Consequently, the ratcheting jaw (20) is prevented from being worn away by abrasion or striking.

The engaging area (23) is formed on the backward area of the ratcheting jaw (20) and comprises a backward area, an inner surface and an abutting surface (232). The inner surface of the engaging area (23) is projecting inward from the backward area of the curved slot (16) and comprises an engaging surface (231). The engaging surface (231) is formed on the inner surface of the engaging area (23) and comprises a backward area. The abutting surface (232) is formed on the backward area of the engaging area (23). The engaging surface (231) of the ratcheting jaw (20) further has a curved surface (233). The curved surface (233) protrudes inwardly from the backward area of the engaging surface (231) of the ratcheting jaw (20) and prevents slipping or disengaging.

The spring (30) is mounted between the wrench body (10) and the ratcheting jaw (20) and provides a force to drive the ratcheting jaw (20) sliding forward and retracting backward relative to the curved slot (16).

The travel of the ratcheting jaw (20) is limited by the pin (17) and guide hole (21). In an alternative embodiment, two curved holes similar to the guide hole (21) may be respectively formed through the two side walls (161), and the pin (17) is penetrated through the ratcheting jaw (20) and slidably through the curved holes. Such structure and another possible structures appreciated by a skilled artisan in the field are also within the scope of the present invention.

Figure 3:
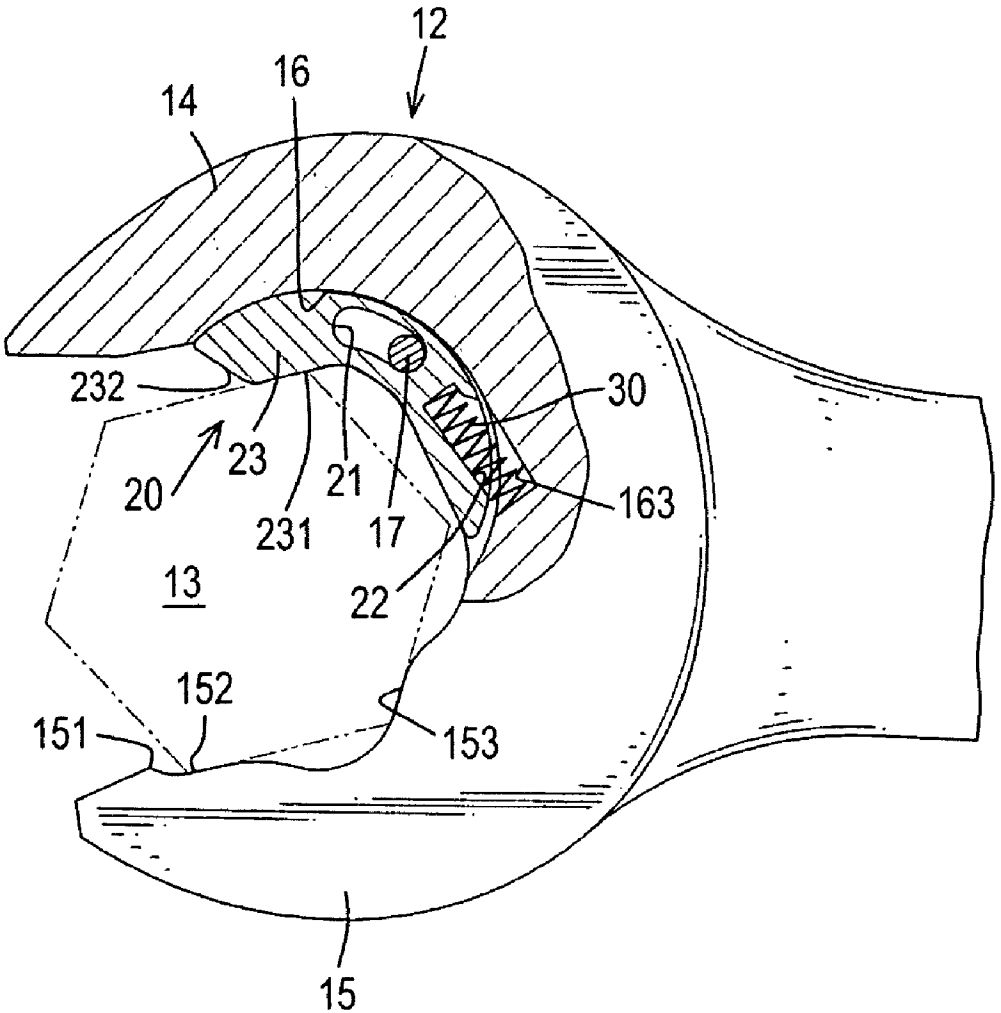
FIG. 3 is an enlarged top view in partial section of the ratchet wrench in FIG. 1.
Figures 4A, 4B:
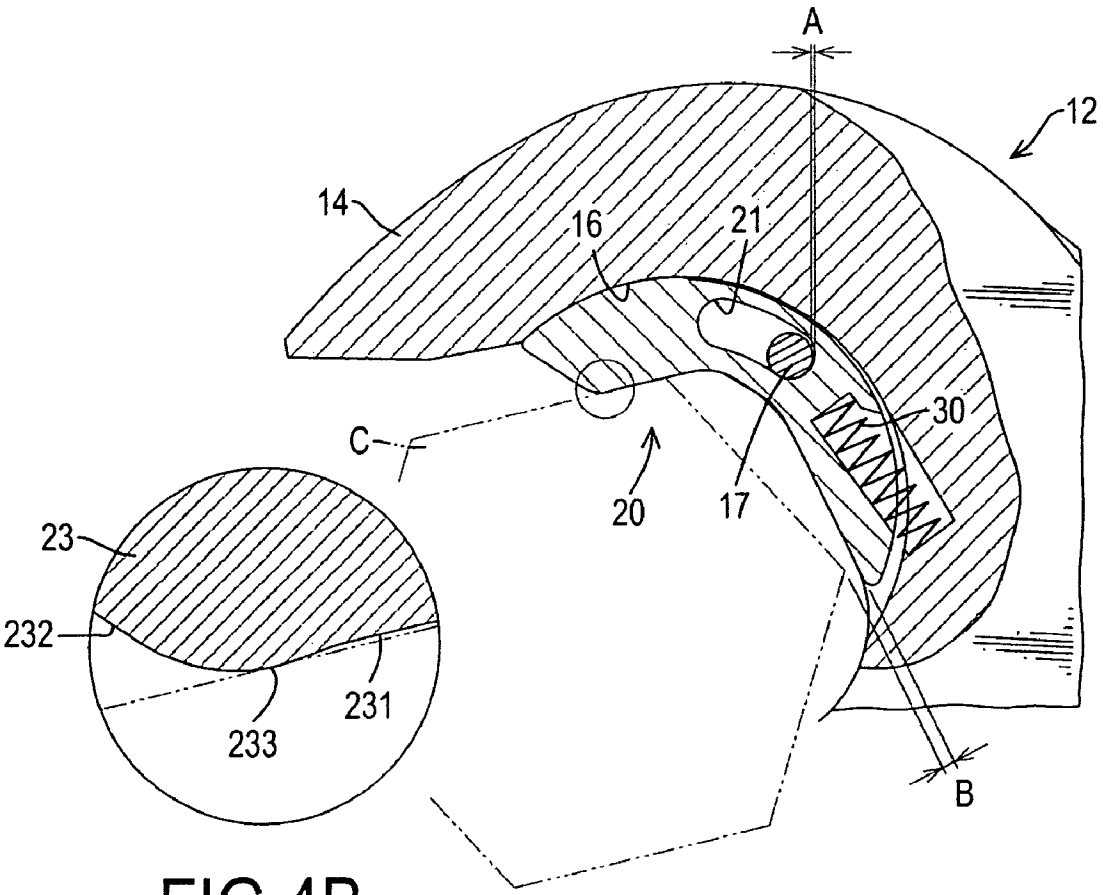
FIG. 4A is an enlarged top view in partial section of the ratchet wrench in FIG. 3.
FIG. 4B is a further enlarged top view in partial section of the ratchet wrench in FIG. 3.
Figure 5:
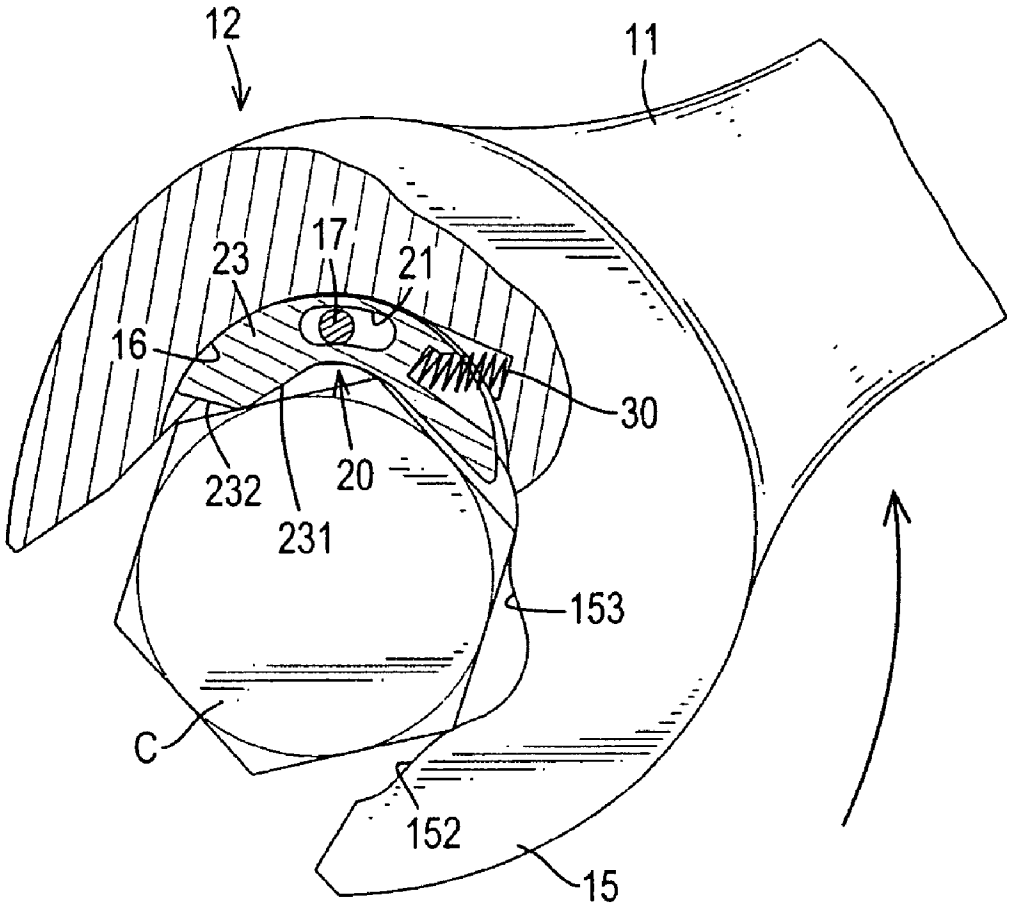
FIG. 5 is an operational top view in partial section of the ratchet wrench in FIG. 1 being rotated in a backward direction.

With reference to FIGS. 3 to 5, when the first embodiment of the ratchet wrench in accordance with the present invention is in use, the bolt (C) is placed in the opening (13). The engaging surfaces (152, 231) on the second jaw (15) and ratcheting jaw (20) engage two opposite flats of the head of the bolt (C). The supporting surface (153) on the second jaw (15) abuts with a flat on the bolt head. The flat of the head of the blot (C) abutted with the engaging surface (231) is also abutted with the protruding curved surface (233). Thus an extremely small gap is formed between the engaging surface (231) and the flat of the head of the bolt (C).

When the head (12) is rotated in the forward direction with an increasing force through the handle (11), the first jaw (14) will deform slightly to tightly abut the engaging surface (231) of the ratcheting jaw (20) with the flat of the head of the blot (C). The inwardly protruding curved surface (233) and the limiting protrusion (151) of the second jaw (15) will tightly engage the bolt (C) and prevent the bolt (C) from slipping or disengaging from the opening (13).

An embodiment of the curved slot (16) has an inner surface having a shape composed of a series of arcs, wherein each of the arcs is a segment of a different circle. When the ratcheting jaw (20) slide along the arcs, the ratcheting jaw (20) slides along a series of discontinued movements. In each movement, the arcs of the inner surface of the curved slot (16) provides a resistance force toward the ratcheting jaw (20) to prevent the ratcheting jaw (20) from inwardly retracting while the head (12) is rotated in the forward direction. Such configuration makes a more powerful engagement possible.

When the head (12) is rotated in the backward direction, the flat of the head of the bolt (C) pushes the abutting surface (232) of the ratcheting jaw (20). The ratcheting jaw (20) slides in the forward direction relatively to the curved slot (16) and force the engaging area (23) retracted inside the curved slot (16). Such action allows the head of the blot (C) to escape from the engaging surface (231) and allows the head (12) to ratchetingly rotate about the bolt head. When the abutting surface (232) slide over the corner of the head of the bolt (C), the spring (30) (or a resilient body) pushes the ratcheting jaw (20) return. Thus it is ready for applying a next turning stroke to the head of the bolt (C). Rotating the head in the forward or backward direction allows tightening the bolt (C) without removing the ratchet wrench from the bolt (C).

The curved slot (16) is recessed in the inner surface of the head (12). The curved slot (16) may be formed with a fraise or a key slot cutter of a central machine tool. The precision of the curved slot (16) in size will be maintained with such a single manufacturing process.

The ratcheting jaw (20) is slidably received within the curved slot (16), and the engaging area (23) for engaging the head of the bolt (C) is projecting out from the curved slot (16). The inner surface at the forward area of the ratcheting jaw (20) has a shape corresponding to the peripheral surface of the opening (13). Accordingly, the opening (13) and the ratcheting jaw (20) effectively engage the bolt head of the bolt (C).

The engaging surface (231) of the ratcheting jaw (20) and the engaging surface (152) of the second jaw (15) are used to engage the head of the blot (C). The flat of the head of the blot (C) is abutted with the engaging surface (231) of the ratcheting jaw (20), and the force applied to the ratcheting jaw (20) can be completely transferred to the first jaw (14) with the tight abutment between the ratcheting jaw (20) with the inner surface of the curved slot (16). Thus, the first jaw (14) and the second jaw (15) will engage the head of the bolt (C) tightly, and the bolt (C) can be tightened effectively.

With further reference to FIGS. 4A and 4B, the ratcheting jaw (20) is slidably mounted in the curved slot (16), and a ratcheting space (A) is formed between the pin (17) and the forward area of the guide hole (21). Thus, when loosening or tightening bolts (C) with different slightly in sizes, with the slight arc-sliding action of the ratcheting jaw (20), the engaging surface (231) may be adjusted to an appropriate engaging angle to the head of the bolt (C). Consequently, different bolts in different sizes can be tightly engaged to make the ratchet wrench in accordance with the present invention versatile in use.

Comparing to a conventional ratchet wrench, the ratcheting jaw (20) slides in a curved movement, the curved slot (16) does not have to be formed with a deep depth. Thus, the thickness of first jaw (14) can be reduced and failure of the jaw (14) can be prevented. The ratchet wrench in accordance with the present invention can be applied to rotate bolts with small sizes, and the structural strength of the ratchet wrench can also be enhanced.

In addition, at least one side wall (161) is formed integrally on the at least one side of the curved slot (16), so conventional welding cover plates is no longer necessary. The integral structure provides a higher strength and prevents failure when be applied with an impact.

In the first embodiment of the present invention, two side walls (161) are formed respectively on two sides of the curved slot (16). In an alternative embodiment, one side of the curved slot (16) may be formed as a lateral opening while the other side remains as a side wall (161). The pin (17) is penetrated through the side wall (161) and is inserted in the curved slot (16) and the guide hole (21) of the ratcheting jaw (20). Thus, the ratcheting jaw (20) is positioned with the pin (17) and the travel of the ratcheting jaw (20) is also limited by the pin (17). In other words, the configurations concerning one side wall (161) or two side walls (161) are within the scope of the present invention.

In the first embodiment of the present invention, a bottom recess (163) is formed in the inner surface of the curved slot (16) and receives the spring (30) in corporation with the spring recess (22) of the ratcheting jaw (20). The spring (30), being a resilient body, provides a force for driving the ratcheting jaw (20) sliding forward and retracting backward. Other means for providing the force to the ratcheting jaw (20) are described as followings with reference to FIGS. 6 to 9.

Figure 6:
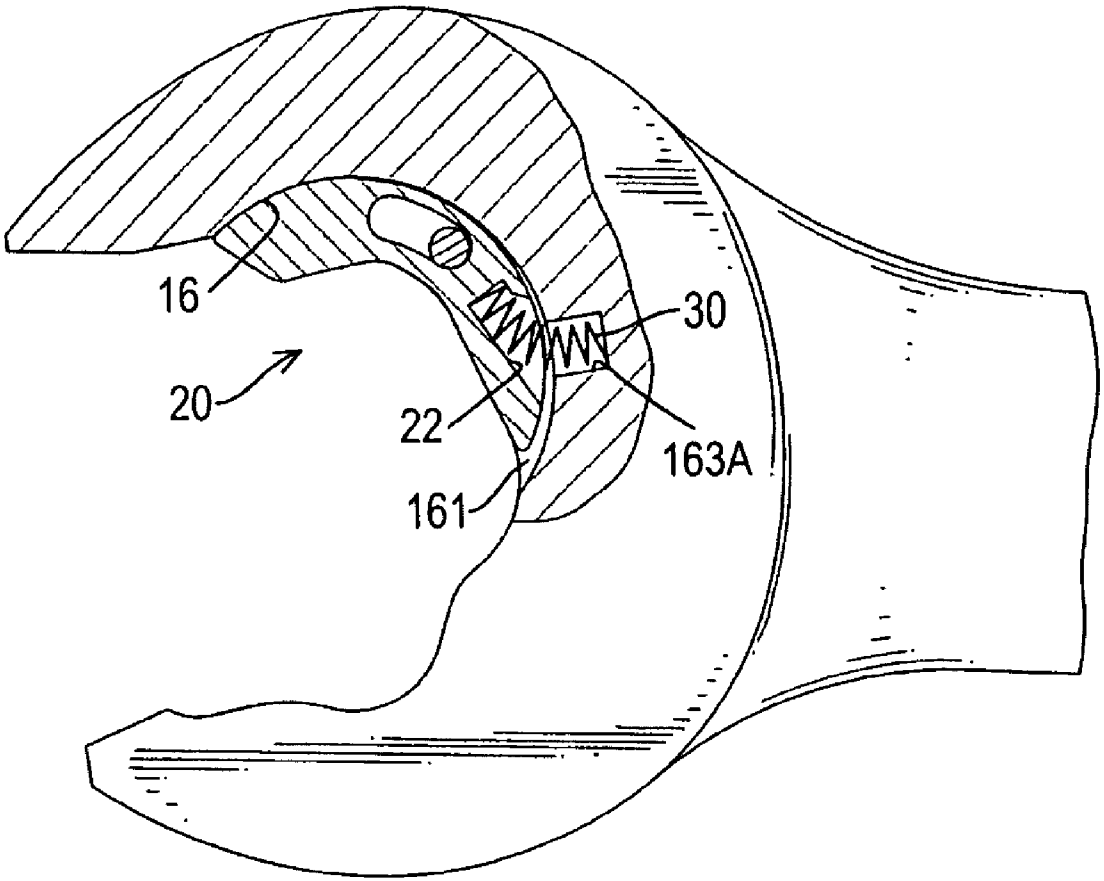
FIG. 6 is a top view in partial section of a second embodiment of a ratchet wrench in accordance with the present invention.

With reference to FIG. 6, an insertion recess (163A) is formed perpendicularly in the forward area of the curved slot (16).

In the second embodiment of the present invention, the insertion recess (163A) is formed in the central area of the curved slot (16) near the forward area of the curved slot (16). The spring (30) is inserted in the insertion recess (163A) and has an outer end. The outer end of the spring (30) is projecting toward and inserted into the spring recess (22) and abuts with the backward end of the spring recess (22).

Other structures, actions and effects as well as configurations concerning one side wall (161) or two side walls (161) of the second embodiment are the same with the aforementioned first embodiment. Relevant descriptions thereof are omitted.

Figure 7:
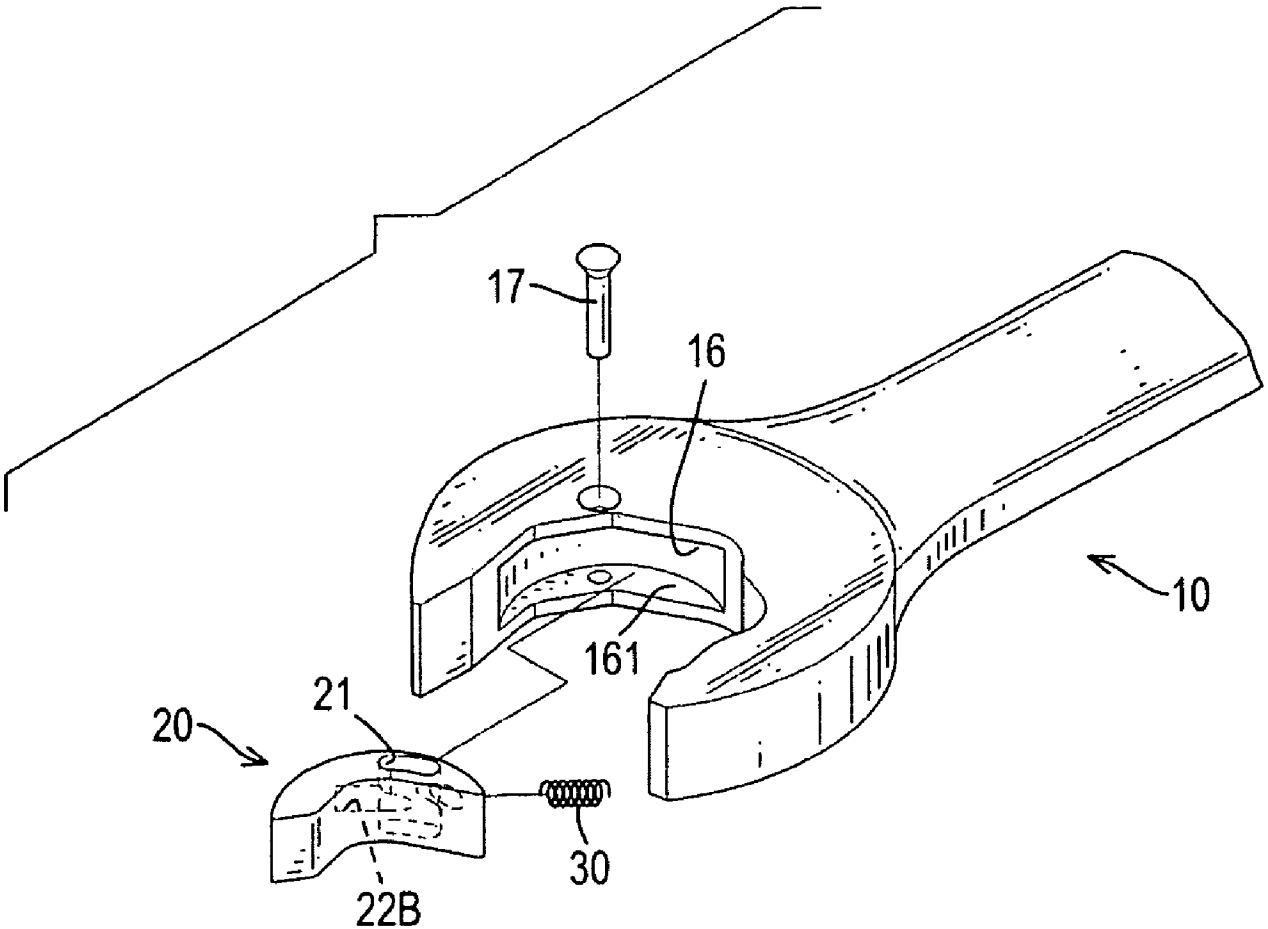
FIG. 7 is an exploded perspective view of a third embodiment of a ratchet wrench in accordance with the present invention.
Figure 8:
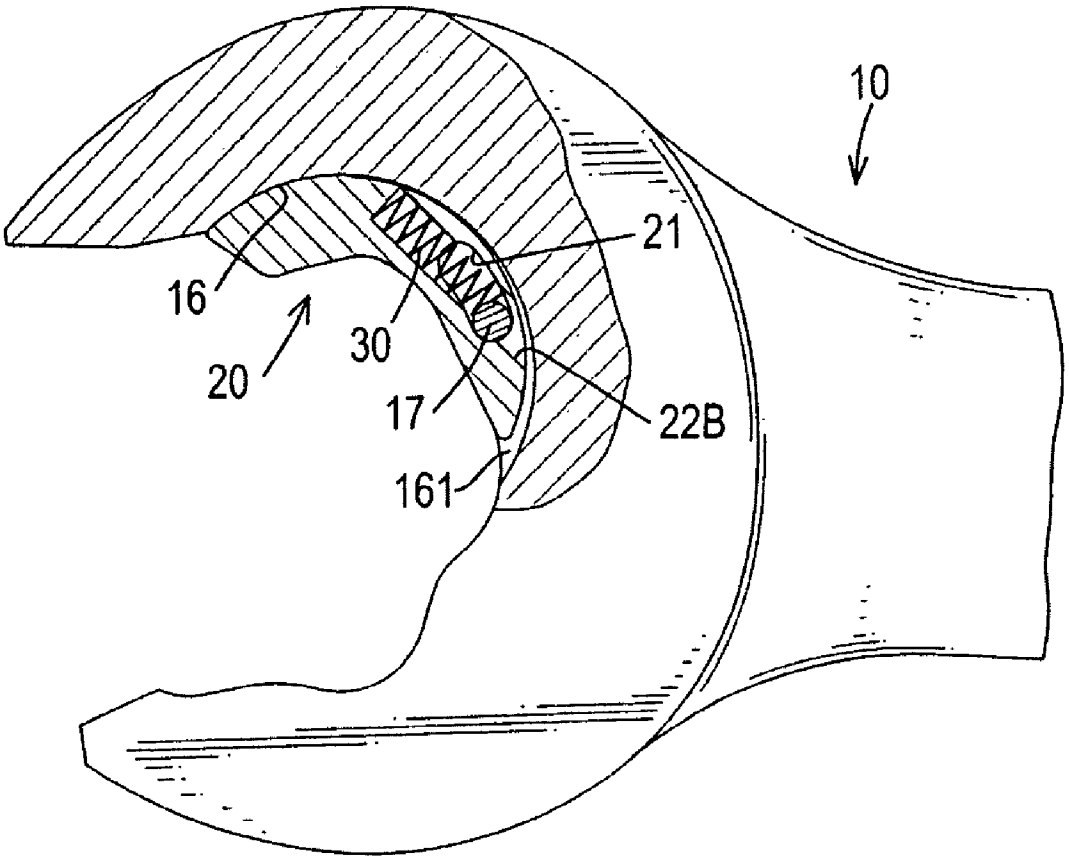
FIG. 8 is a top view in partial section of the ratchet wrench in FIG. 7.

With reference to FIGS. 7 and 8, the configuration of the spring (30) 17 being abutted between the inner surface of the curved slot (16) of wrench body 18 (10) and the ratcheting jaw (20) of the first embodiment is altered in the third 19 embodiment of the present invention. Instead of such configuration, the spring (30) is abutting between the pin (17) of the wrench body (10) and the ratcheting jaw (20), wherein the inner surface of the curved slot (16) of the wrench body (10) is kept from abutting with the spring (30).

In the third embodiment of the present invention, a penetrating channel (22B) is inwardly formed in the outer surface at the forward area of the ratcheting jaw (20) through the guide hole (21) and has an inner end. The pin (17) the forward area of the guide hole (21). The spring (30) is mounted in the penetrating channel (22B) and has two ends abutting respectively with the inner end of the penetrating channel (22B) and the pin (17) of the wrench body (10). A force for driving the ratcheting jaw (20) sliding forward and retracting backward is provided by the spring (30) in such configuration.

Comparing to the first and second embodiments, in the third embodiment, during a manufacturing process, the spring (30) is firstly inserted into the penetrating channel (22B). After inserting the ratcheting jaw (20) into the curved slot (16), the pin (17) is inserted through the two pinholes (162) and the guide hole (21) to assemble the ratcheting jaw (20) in the curved slot (16). Since the adjustment for positioning the spring (30) is not necessary, the process will be completed in a shorter time than that of the other embodiments.

Other structures, actions and effects as well as configurations concerning one side wall (161) or two side walls (161) of the third embodiment are the same with the aforementioned first embodiment. Relevant descriptions thereof are omitted.

Figure 9:
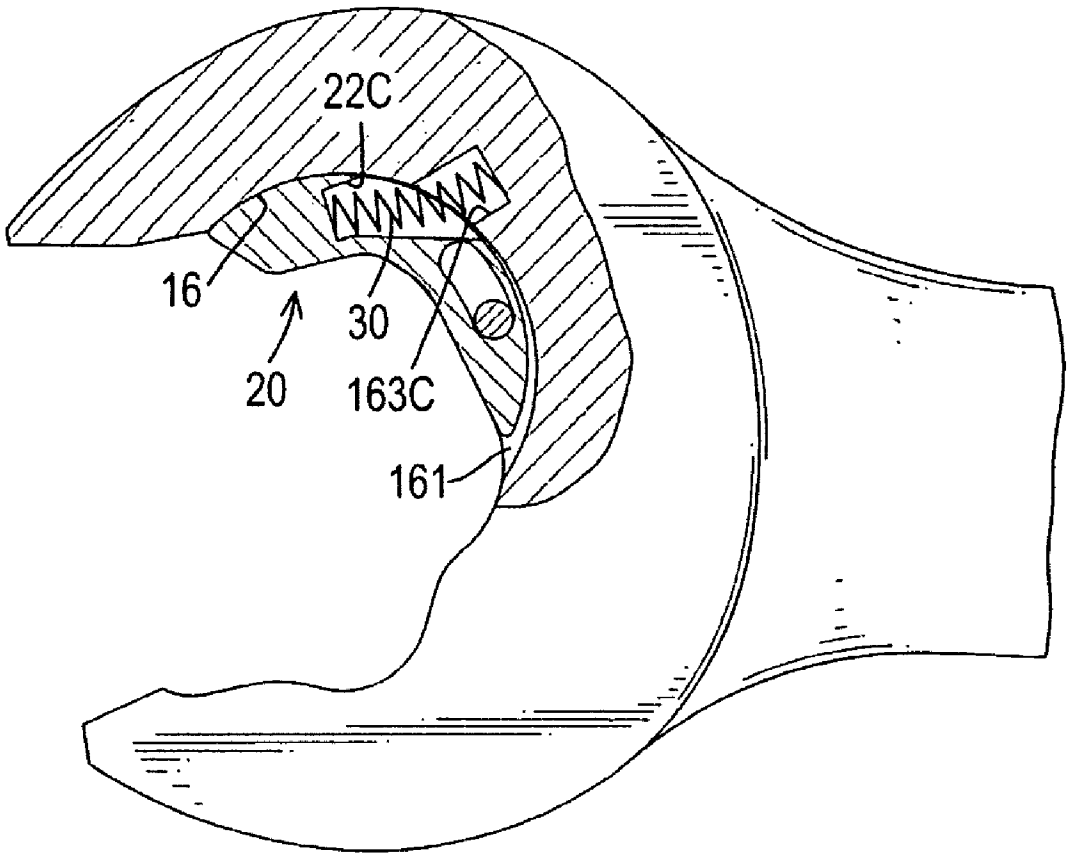
FIG. 9 is a top view in partial section of a forth embodiment of a ratchet wrench in accordance with the present invention.

With reference to FIG. 9, in the forth embodiment of the present invention, a second bottom recess (163C) is formed in the inner surface at the central area of the curved slot (16) and has an inner end. A second spring recess (22C) is formed on the outer surface at the backward area of the ratcheting jaw (20), corresponds to the second bottom recess (163C) and has a backward area. The spring (30) is mounted in the second bottom recess (163C) and the second spring recess (22C) and has two ends abutting respectively with the inner end of the second bottom recess (163C) and the backward area of the second spring recess (22C). A force for driving the ratcheting jaw (20) sliding forward and retracting backward is provided by the spring (30) in such configuration.

Other structures, actions and effects as well as configurations concerning one side wall (161) or two side walls (161) of the forth embodiment are the same with the aforementioned first embodiment. Relevant descriptions thereof are omitted.

In the first, second, third or the forth embodiment, the curved slot (16) is formed in the central area of the opening (13) near the first side of the opening (13). The ratcheting jaw (20) slides and is received in the first jaw (14). The ratcheting jaw (20) allows ratchetably rotation of the head (12) in the backward direction and apply a torque to the head of the bolt (C) in the forward direction. In another alternative embodiment, the curved slot (16) may be formed in the central area of the opening (13) near the second side of the opening (13).

Figure 10:
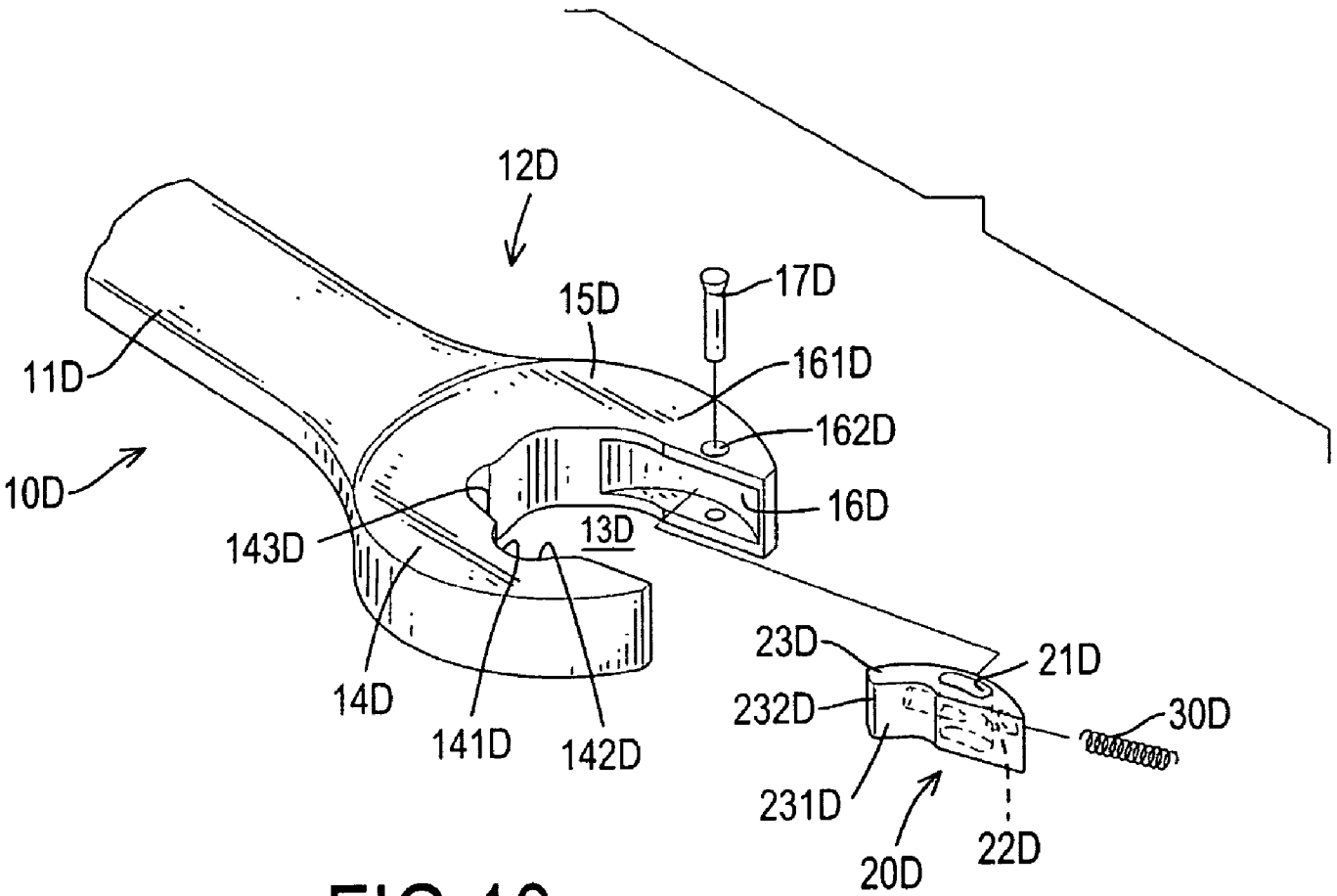
FIG. 10 is an exploded perspective view of a fifth embodiment of a ratchet wrench in accordance with the present invention.
Figure 11A:
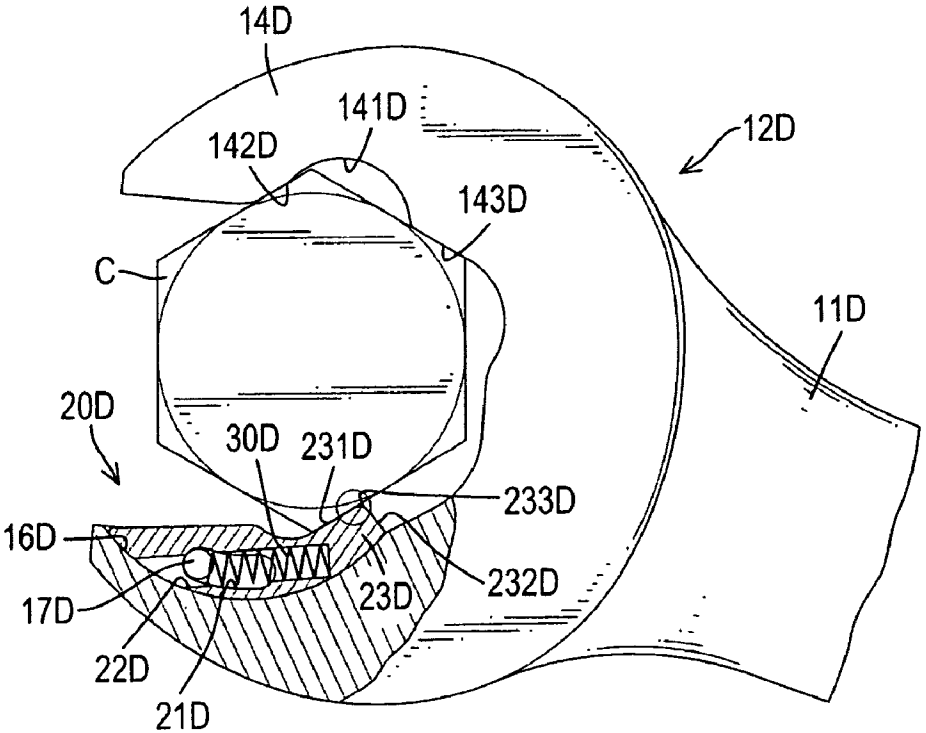
FIG. 11A is a top view in partial section of the ratchet wrench in FIG. 10.
Figure 11B:
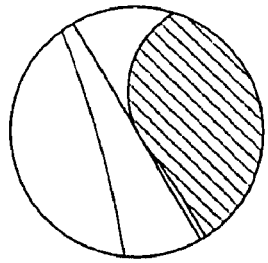
FIG. 11B is an enlarged top view in partial section of the ratchet wrench in FIG. 10.
Figure 12:
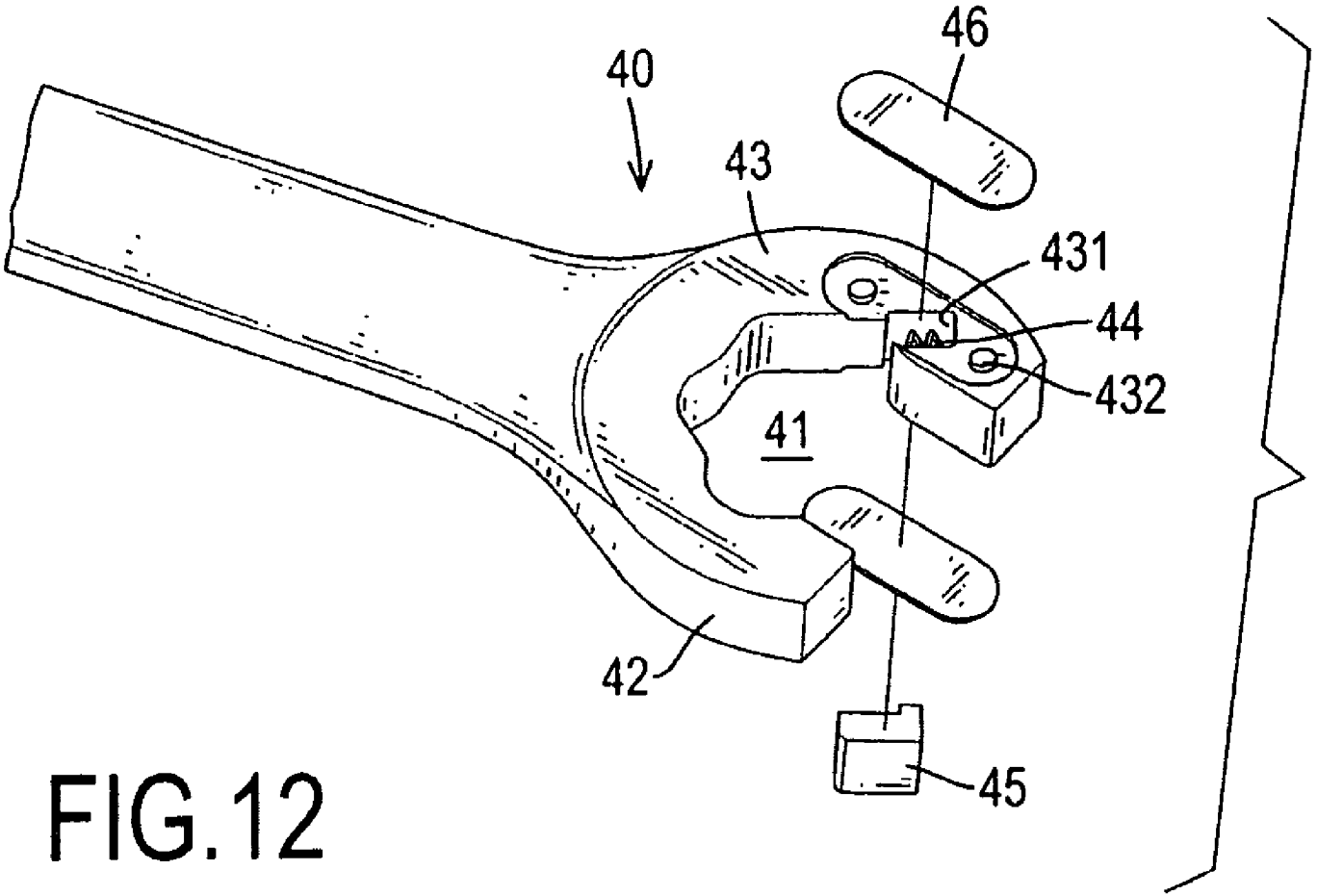
FIG.12 PRIOR ART
FIG. 12 is an exploded perspective view of a conventional ratchet wrench in accordance with the prior art.

With reference to FIGS. 10, 11A and 11B, a fifth embodiment of a ratchet wrench in accordance with the present invention comprises a wrench body (10D), a ratcheting jaw (20D) and a spring (30D). The wrench body (10D) comprises a handle (11D), a head (12D), an opening (13D), a first jaw (14D), a second jaw (15D) and a curved slot (16D).

The handle (11D) comprises a front end. The head (12D) is formed on the front end of the handle (11D) and comprises a front end, a rear end, a first side, a second side and an inner surface. The opening (13D) is defined in the front end of the head (12D) and comprises a central area, a first side, a second side and a peripheral surface. The peripheral surface is the inner surface of the inner surface of the head (12D). The first jaw (14D) is formed on the head (12D), corresponds to the first side of the opening (13D) and comprises an inner surface. The inner surface of the first jaw (14D) has a central area, a front end and a rear end. The second jaw (15D) is formed on the head (12D), corresponds to the second side of the opening (13D) and comprises an inner surface. The inner surface of the second jaw (15D) has a front end and a rear end. A backward area is defined within the opening (13D) as an area adjacent to the first jaw (14D). A forward area is defined within the opening (13D) as an area adjacent to the second jaw (15D).

The first jaw (14D) further has a recession (141D), an engaging slope (142D) and a supporting surface (143D). The recession (141D) is formed in the central area of the inner surface of the first jaw (14D) and has a front side and a rear side. The engaging slope (142D) is downwardly and backwardly inclined relative to and formed on the front side of the recession (141D). The supporting surface (143D) is formed on the rear end of the inner surface of the first jaw (14) inclined at an angle of 60 degrees relative to the engaging slope (142D).

The curved slot (16D) is formed in the central area of the opening (13D) near the second side of the opening (13D) and comprises a central area, a forward area, a backward area, an inner surface, two sides and two side walls (161D). The two side walls (161D) are formed respectively on the sides of the curved slot (16D). The two pinholes (162D) are formed respectively through the two side walls (161D). The inner surface of the curved slot (16D) may be formed as an arc being a segment of a single circle or as a series of arcs each being a segment of a different circle. A pin (17D) is inserted in the pinholes (162D).

The ratcheting jaw (20D) is a curved block capable of sliding forward and retracting backward relative to the curved slot (16D) and comprises a forward area, a backward area, an inner surface, an outer surface and an engaging area (23D). The outer surface of the ratcheting jaw (20D) has a shape that corresponds to the inner surface of the curved slot (16D) to allow the ratcheting jaw (20D) to slide inside the curved slot (16D). The ratcheting jaw (20D) further has a guide hole (21D). The guide hole (21D) is a curved hole and has a forward area and a backward area. The pin (17D) penetrates through the curved slot (16D) and the forward area of the guide hole (21D).

The inner surface at the backward area of the ratcheting jaw (20D) has a shape corresponding to the peripheral surface of the opening (13D) to allow a tight engagement of the ratcheting jaw (20D) with a head of a bolt (C). The ratcheting jaw (20D) further has a penetrating channel (22D). The penetrating channel (22D) is inwardly formed in the outer surface at the forward area of the ratcheting jaw (20) through the guide hole (21) and has an inner end.

The engaging area (23D) is formed on the backward area of the ratcheting jaw (20D) and comprises a backward area, an inner surface and an abutting surface (232D). The inner surface of the engaging area (23D) is projecting inward from the backward area of the curved slot (16D) and comprises an engaging surface (231D). The engaging surface (231D) is formed on the inner surface of the engaging area (23D), corresponds to the engaging slope (142D) and comprises a backward area. The abutting surface (232D) is formed on the backward area of the engaging area (23D). The engaging surface (231D) of the ratcheting jaw (20D) further has a curved surface (233D). The curved surface (233D) protrudes inwardly from the backward area of the engaging surface (231D).

The spring (30D) is mounted in the penetrating channel (22D) and has two ends abutting respectively with the inner end of the penetrating channel (22D) and the pin (171D) to provide a force for driving the ratcheting jaw (20D) sliding forward and retracting backward.

With reference to FIGS. 10, 11A and 11B, when the fifth embodiment of the ratchet wrench in accordance with the present invention is in use, the bolt (C) is placed in the opening (13D). The engaging slope (142D) and the engaging surface (231D) of ratcheting jaw (20D) engages two opposite flats of the head of the bolt (C). The supporting surface (143D) abuts with a flat of the bolt head.

The head (12D) may be rotated in the forward direction with an increasing force to rotate and tighten the bolt (C) in the forward direction. In order to provide a next turning stroke of the tightening action to the bolt (C), the head (12D) is rotated in the backward direction. The flat of the head of the bolt (C) pushes against the abutting surface (232D) of the ratcheting jaw (20D). The ratcheting jaw (20D) slides in the forward direction relatively to the curved slot (16D) and force the engaging area (231D) to retract into the curved slot (16D). Such action allows the head of the blot (C) to escape from the engaging surface (231D) and allows the head (12D) to ratchetingly rotate about the bolt head. When the abutting surface (232D) slides over the corner of the head of the bolt (C), the spring (30) pushes the ratcheting jaw (20D) return. Thus it is ready for applying a next turning stroke to the head of the bolt (C) to repeat the tightening action.

The fifth embodiment is similar to the first embodiment. The curved surface (233D) resembles the same structure and provides the same effect as that of the curved surface (233) in the first embodiment. Descriptions regarding the curved surface (233D) are omitted.

In the fifth embodiment, the ratcheting jaw (20D) is mounted on the second side of the head (12) instead of the first side thereof. Since the present invention is used with rotations in the forward or backward directions, the ratcheting jaw (20D) and curved slot (16D) can provide a same function no matter that the ratcheting jaw (20D) and the slot (16D) are arranged on which side of the head (12D). The only difference is that the inner surface at the forward area of the ratcheting jaw (20D) corresponds to the peripheral surface of the opening (13D) in a different manner. Other actions and effects are the same as the third embodiment or other embodiments.

Furthermore, although the spring (30D) is abutted between the inner end of the ratcheting jaw (20D) and the pin (17D), other configurations disclosed in the first, second, third and forth embodiments may also be applied to the fifth embodiment based on the same backward and forward orientations. Thus descriptions thereof are omitted.

With the structure disclosed, the present invention is able to mitigate or obviate the problems of a conventional ratchet wrench.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ratchet wrench comprising a wrench body comprising a handle comprising a front end;

a head being formed on the front end of the handle and comprising a front end;

a rear end;

a first side;

a second side; and an inner surface;

an opening being defined in the front end of the head and comprising a forward area;

a backward area;

a central area;

a first side;

a second side; and a peripheral surface being the inner surface of the head;

a first jaw being formed on the head, corresponding to the first side of the opening and comprising
an inner surface having
a central area;
a front end; and
a rear end;
a second jaw being formed on the head, corresponding to the second side of the opening and comprising
an inner surface having
a front end; and
a rear end;
a curved slot being formed in the inner surface of the head corresponding to the peripheral surface of the opening and comprising
a central area;
a forward area;
a backward area;
an inner surface;
at least one side; and
at least one side wall being formed on the at least one side of the curved slot;
a ratcheting jaw being a curved block capable of sliding forward and retracting backward relative to the curved slot and comprising
a forward area;
a backward area;
an inner surface;
an outer surface; and
an engaging area being formed on the backward area of the ratcheting jaw and comprising
a backward area;
an inner surface being projecting inward from the backward area of the curved slot and comprising
an engaging surface being formed on the inner surface of the engaging area and comprising
a backward area; and
an abutting surface being formed on the backward area of the engaging area; and
a spring being abutted between the wrench body and the ratcheting jaw and providing a force for driving the ratcheting jaw sliding forward and retracting backward relative to the curved slot, wherein
the ratcheting jaw further has
a guide hole being a curved hole and having
a backward area; and
a forward area; and
the side wall further has
a pin being mounted on the side wall and penetrating through the curved slot and the forward area of the guide hole.

2. The ratchet wrench as claimed in claim 1, wherein
the curved slot has
two sides;
two side walls being formed respectively on the sides of the curved slot;
two pinholes being formed respectively through the two side walls;
the pin is inserted through the pinholes; and
the inner surface at the forward area of the ratcheting jaw has a shape corresponding to
the peripheral surface of the opening.

3. The ratchet wrench as claimed in claim 2, wherein the curved slot further has
a bottom recess being formed in the inner surface near the backward area of the curved slot and having
a forward area;
the ratcheting jaw further has
a spring recess being formed in the outer surface at the forward area of the ratcheting jaw, corresponding to the bottom recess and having
a backward area; and
the spring is inserted in the spring recess and has
two ends abutting respectively with the backward area of the spring recess and the forward area of the bottom recess.

4. The ratchet wrench as claimed in claim 2, wherein the curved slot further has
an insertion recess being formed in the central area of the curved slot near the forward area of the curved slot;
the ratcheting jaw further has
a spring recess being formed in the outer surface at the forward area of the ratcheting jaw, corresponding to the insertion recess and having
a backward area; and
the spring is inserted in the insertion recess and has
an outer end projecting toward and inserted into the spring recess and abutting with the backward end of the spring recess.

5. The ratchet wrench as claimed in claim 2, wherein the ratcheting jaw further has
a penetrating channel being inwardly formed in the outer surface at the forward area of the ratcheting jaw through the guide hole and having
an inner end; and
the spring is inserted in the penetrating channel and has
two ends abutting respectively to the inner end of the penetrating channel and the pin of the wrench body.

6. The ratchet wrench as claimed in claim 2, wherein the curved slot further has
a second bottom recess being formed in the inner surface at the central area of the curved slot and having
an inner end;
the ratcheting jaw further has
a second spring recess being formed in the outer surface at the backward area of the ratcheting jaw, corresponding to the second bottom recess and having
a backward area; and
the spring is mounted in the second bottom recess and the second spring recess and has
two ends abutting respectively with the inner end of the second bottom recess and the backward area of the second spring recess.

7. The ratchet wrench as claimed in claim 1, wherein
the second jaw further has
a limiting protrusion being formed on the front end of the inner surface of the second jaw and comprising
a rear side;
an engaging surface being formed on the inner surface of the second jaw at a position adjacent to the rear side of the limiting protrusion and having
a rear side;
a supporting surface being formed on the rear end of the inner surface of the second jaw, corresponding to the rear side of the engaging surface and inclined at an angle of 60 degrees relative to the engaging surface; and
the curved slot is formed in the central area of the opening near the first side of the opening.

8. The ratchet wrench as claimed in claim 7, wherein the engaging surface of the ratcheting jaw further has
a curved surface protruding inwardly from the backward area of the engaging surface of the ratcheting jaw; and
a ratcheting space is form between the forward area of the guide hole and the pin.

9. The ratchet wrench as claimed in claim 1, wherein the first jaw further has a recession being formed on the central area of the inner surface of the first jaw and having a front side; and a rear side;

an engaging slope being downwardly and backwardly inclined relative to and formed on the front side of the recession; and a supporting surface being formed on the rear end of the inner surface of the first jaw inclined at an angle of 60 degrees relative to the first engaging slope; and the curved slot is formed in the central area of the opening near the second side of the opening.

10. The ratchet wrench as claimed in claim 9, wherein the engaging surface of the ratcheting jaw further has a curved surface protruding inwardly from the backward area of the engaging surface of the ratcheting jaw; and a ratcheting space is form between the forward area of the guide hole and the pin.

11. The ratchet wrench as claimed in claim 1, wherein the engaging surface of the ratcheting jaw further has a curved surface protruding inwardly from the backward area of the engaging surface of the ratcheting jaw; and a ratcheting space is form between the forward area of the guide hole and the pin.

* * * * *